US008565660B2

(12) United States Patent
Arakawa

(10) Patent No.: US 8,565,660 B2
(45) Date of Patent: Oct. 22, 2013

(54) FIXATION DEVICE AND IMAGE FORMATION APPARATUS

(75) Inventor: Kojiro Arakawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 153 days.

(21) Appl. No.: 13/028,641

(22) Filed: Feb. 16, 2011

(65) Prior Publication Data

US 2011/0200372 A1 Aug. 18, 2011

(30) Foreign Application Priority Data

Feb. 18, 2010 (JP) ..... 2010-034084

(51) Int. Cl.
*G03G 15/20* (2006.01)

(52) U.S. Cl.
USPC ..... 399/333; 399/328

(58) Field of Classification Search
USPC ..... 399/324, 325, 328, 329, 333
See application file for complete search history.

(56) References Cited

U.S. PATENT DOCUMENTS 5,353,104 A * 10/1994 Kato et al. ..... 399/274
5,708,947 A * 1/1998 Kagawa et al. ..... 399/328
5,819,147 A * 10/1998 Shoji ..... 399/284
5,999,788 A * 12/1999 Kanesawa et al. ..... 399/329
7,333,762 B2 * 2/2008 Oishi et al. ..... 399/329
7,496,323 B2 * 2/2009 Kataoka et al. ..... 399/346
2005/0254866 A1 * 11/2005 Obata et al. ..... 399/328
2007/0196145 A1 * 8/2007 Matsumoto et al. ..... 399/329
2008/0013993 A1 * 1/2008 Obata et al. ..... 399/331

FOREIGN PATENT DOCUMENTS

JP H11-016667 A 1/1999
JP 2005-275371 A 10/2005
JP 2009-271441 A 11/2009

* cited by examiner

*Primary Examiner* — Clayton E Laballe
*Assistant Examiner* — Jas Sanghera
(74) *Attorney, Agent, or Firm* — Marvin A. Motsenbocker; Mots Law, PLLC

(57) ABSTRACT

A fixation device includes: a rotation member provided to be rotatable; a conveyance member provided in contact with the rotation member and configured to convey media; and a first press member configured to press the conveyance member against the rotation member. The first press member includes, at an area in contact with the conveyance member, a slide part including convex surfaces, each of which is a part of a spherical surface.

17 Claims, 12 Drawing Sheets

FIXATION DEVICE AND IMAGE FORMATION APPARATUS

CROSS REFERENCE TO RELATED APPLICATIONS

This application claims priority based on 35 USC 119 from prior Japanese Patent Application No. 2010-034084 filed on Feb. 18, 2011, entitled "Fixation Device and Image Formation Apparatus", the entire contents of which are incorporated herein by reference.

BACKGROUND OF THE INVENTION

1. Field of the Invention

The invention relates to a fixation device and an image formation apparatus.

2. Description of Related Art

A conventional image formation apparatus such as a printer, a copy machine, a facsimile machine, a MFP (multi-functional printer/peripheral), for example, the printer is equipped with an image formation unit, a LED head, a transfer roller, a fixation unit as a fixation device, or the like. The image formation unit includes a photosensitive drum, a charge roller, a development unit, and the like such that the photosensitive drum is opposed to the LED head and the transfer roller. The surface of the photosensitive drum is uniformly charged by the charge roller and exposed by the LED head to form an electrostatic latent image thereon. The electrostatic latent image on the surface of the photosensitive drum is developed by the development unit to form a toner image. The toner image is transferred from the photosensitive drum to a sheet of paper by the transfer roller and fixed to the sheet by the fixation unit, thereby forming an image on the sheet, that is, thereby printing the image on the sheet.

In the case where friction between a conveyance member and a press member, which occurs when the conveyance member and the press member are in slide-contact with each other, is large, a load on a fixation motor serving as a fixation unit driver to drive a rotation member to rotate becomes large. Therefore, there has been proposed a device to reduce the friction between the conveyance member and the press member (see, for example, Japanese Patent Application Laid-Open No. 2005-275371).

SUMMARY OF THE INVENTION

However, in Japanese Patent Application Laid-Open No. 2005-275371, redaction of the friction between the conveyance member and the press member is not sufficient to reduce the load on the fixation motor.

An object of an aspect of the invention is to provide a fixation device and an image formation apparatus in which the load on the fixation device driver is reduced.

An aspect of the invention is a fixation device including: a rotation member provided to be rotatable; a conveyance member provided in contact with the rotation member and configured to convey media; and a first press member configured to press the conveyance member against the rotation member. The first press member includes, at the area in contact with the conveyance member, a slide part including convex surfaces, each of which is a part of a spherical surface.

According to the aspect, the first press member is formed with the slide part including the convex surfaces, each of which is composed of the part of the sphere surface at the area in contact with the conveyance member. This prevents the inner circumferential surface of the conveyance member from being abraded off, resulting in reduction of the amount of the abrasion powder attached to the surface of the first press member and preventing the surface of the first press member from becoming flat, so as to prevent increase of the contact area between the conveyance member and the first press member. As a result, this prevents increased friction between the conveyance member and the first press member when they are in slide-contact with each other and maintains the load on the fixation device driver low for a longer period of time.

DETAILED DESCRIPTION OF EMBODIMENTS

Figure 1:
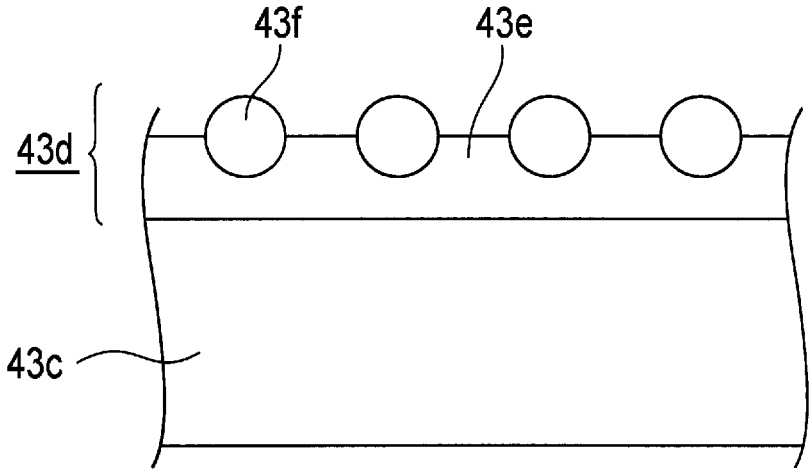
FIG. 1 is a sectional view of a surface layer of a press pad according to a first embodiment of the invention

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

A printer as an image forming apparatus will be described in the following description.

Figure 2:
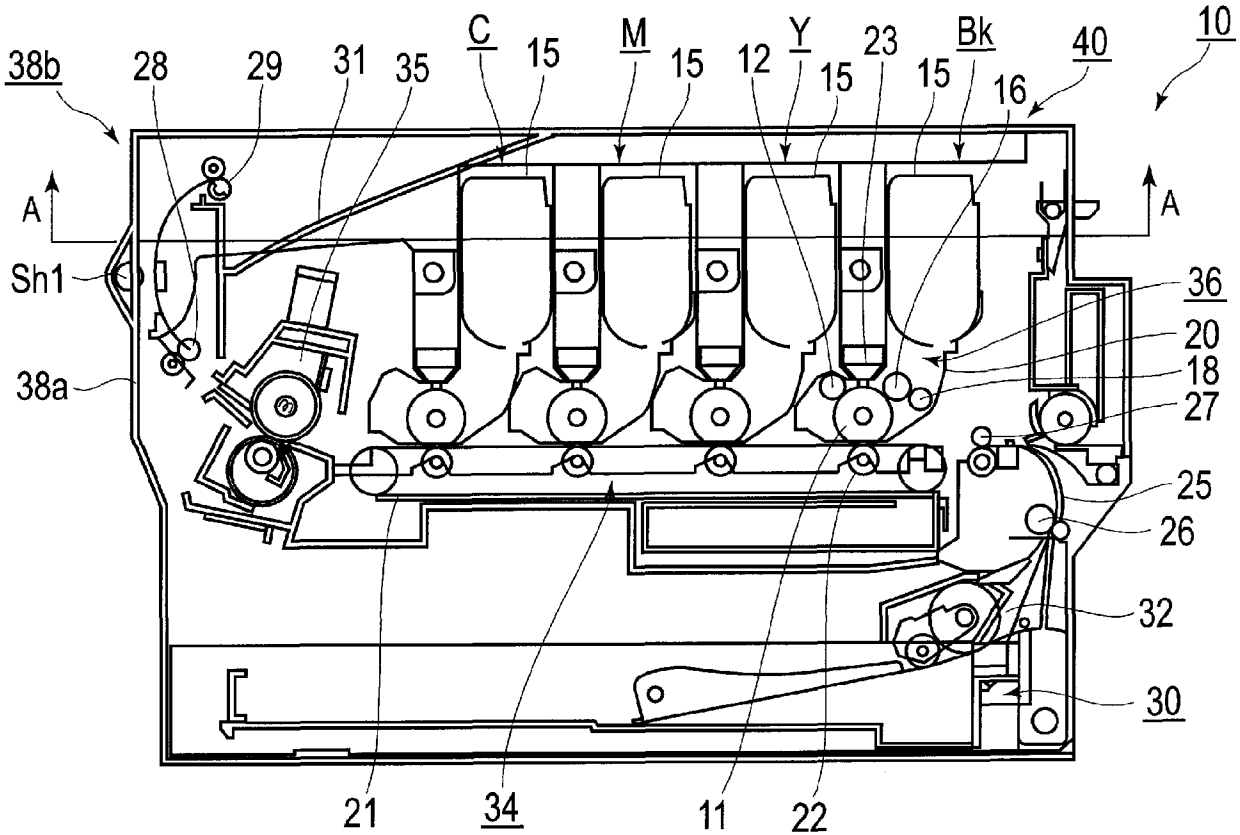
FIG. 2 is a conceptual diagram of a printer according to the first embodiment of the invention.

FIG. 2 is a conceptual diagram of the printer according to the first embodiment of the invention.

In the figure, reference numeral 10 designates the printer, and reference numeral 40 designates a body of printer 10, that is, a printer body. Printer body 40 has therein conveyance path 25 in which an unillustrated sheet of paper serving as a medium is to be conveyed. Provided along conveyance path 25 are rollers 26 to 29 and also image formation units (which may be referred to as ID units) Bk, Y, M, and C to form a toner image as a developer image of each color of black, yellow, magenta, and cyan. Each image formation unit Bk, Y, M, and C includes photosensitive drum 11 as an image carrier.

LED head 23 serving as an exposure device or a recording head is provided adjacent to each image formation unit Bk, Y, M, and C such that LED head 23 faces photosensitive drum 11 in each image formation unit Bk, Y, M, and C. Image transfer unit 34 which conveys the sheet (s) and transfers each toner image to the sheet (s) is provided beneath image formation unit Bk, Y, M, and C. Note that image transfer unit 34 comprises a belt drive unit.

Fixation unit 35, serving as a fixation device, to fix the transferred toner image to the sheet (s) is provided downstream of image formation units Bk, Y, M, and C in the sheet conveyance direction.

In each image formation unit Bk, Y, M, and C, photosensitive drum 11 is driven to rotate at a predetermined rotational speed, so that the surface of each photosensitive drum Bk, Y, M, and C is uniformly charged by charge roller 12 serving as a charging device and thus retains electrical charge thereon. When LED head 23 emits light, the light partially removes the electrical charge on the charged surface of photosensitive drum 11 and thus forms an unillustrated electrostatic latent image serving as a latent image on the charged surface of photosensitive drum 11. Note that charge roller 12 is in press-contact with photosensitive drum 11 at a constant pressure force and is rotated in a direction opposite to the rotational direction of photosensitive drum 11.

Reference numeral 36 designates a development unit, serving as a development device, which is provided adjacent to photosensitive drum 11 and develops the latent image to form the toner image. Development unit 36 includes: development roller 16, serving as a developer carrier, which attaches a toner serving as a developer to photosensitive drum 11; an unillustrated development blade, serving as a developer layer regulation member, which regulates (meters) the thickness of the toner on development roller 16; toner supply roller 18, serving as a developer supplier, which supplies the toner to development roller 16; and the like. Development roller 16 is in press-contact with photosensitive drum 11 at a constant pressure force and is driven to rotate in the direction opposite to the rotational direction of photosensitive drum 11. Toner supply roller 18 is in press-contact with development roller 16 at a constant pressure force and is driven to rotate in the same direction as the rotational direction of development roller 16. Note that photosensitive drum 11, development roller 16, toner supply roller 18, and the like are image formation elements.

Photosensitive drum 11, charge roller 12, development unit 36, and the like are accommodated in image formation unit body 20, which is the body of each image formation unit Bk, Y, M, and C. Toner cartridge 15 serving as a developer cartridge or a developer container, which contains therein the toner, is provided above image formation unit body 20 in such a manner that toner cartridge 15 is detachably attached to image formation unit body 20.

Image transfer unit 34 includes: image transfer belt 21, serving as a conveyance member for an image transfer, which is moveably (rotatably) provided; and transfer roller 22, serving as an image transfer member, which is provided opposite to each photosensitive drum 11. Image transfer belt 21 and transfer roller 22 are energized by an unillustrated power supply with predetermined voltages and consecutively transfer the color toner images on photosensitive drums 11 one upon another onto the sheet.

Printer body 40 includes lower cover 38*a* and upper cover 38*b* which is pivotable about support shaft Sh1 with respect to lower cover 38*a* so as to open and close upper cover 38*b* with respect to section A-A in FIG. 2. Upper cover 38*b* is formed with stacker 31 to stack thereon the sheets that are discharged. Sheet cassette 30, serving as a media container, which contains therein the sheets serving as the media, is provided beneath image transfer unit 34 and at the upper stream end of conveyance path 25. Feeder 32 which feeds the sheets to conveyance path 25 is provided at sheet cassette 30.

Next, operation of printer 10 having the above configuration will be described.

In each image formation unit Bk, Y, M, and C, charge roller 12 uniformly charges the surface of photosensitive drum 11, and LED head 23 emits light onto the charged surface of photosensitive drum 11, thereby forming the electrostatic latent image on the surface of photosensitive drum 11. Next, development unit 36 develops the electrostatic latent image to form the toner image of each color on the surface of photosensitive drum 11.

Meanwhile, the sheets in sheet cassette 30 are fed one by one to conveyance path 25 by feeder 32, conveyed along conveyance path 25 by conveyance rollers 26 and 27, electrostatically attached to image transfer belt 21, and conveyed between image transfer unit 34 and image formation units Bk, Y, M, C by the movement of transfer belt 21. When the sheet is conveyed between image transfer unit 34 and image formation units Bk, Y, M, and C, the toner image of each color is transferred to the sheet, thereby forming a color (multi-color) toner image on the sheet. Next, the sheet is conveyed to fixation unit 35, which fixes the color toner image to the sheet by heating and pressing the color toner image on the sheet, so as to form a color image on the sheet. The sheet having the color image thereon is further conveyed by conveyance rollers 28 and 29 and discharged to stacker 31.

Printer 10 includes therein an external interface which communicates with unillustrated external apparatus and receives print data and an unillustrated controller which receives the print data via the external interface and controls the overall processes of printer 10.

Next, fixation unit 35 will be described.

Figure 3:
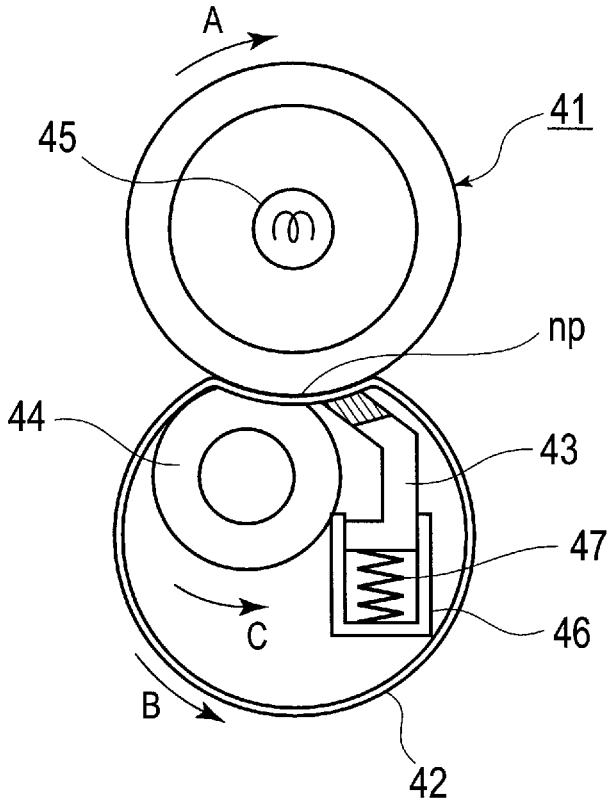
FIG. 3 is a sectional view of a fixation unit according to the first embodiment of the invention.
Figure 4:
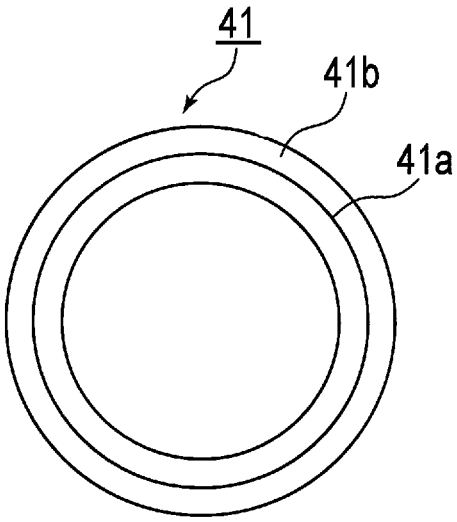
FIG. 4 is a sectional view of a first example of a fixation roller according to the first embodiment of the invention.
Figure 5:
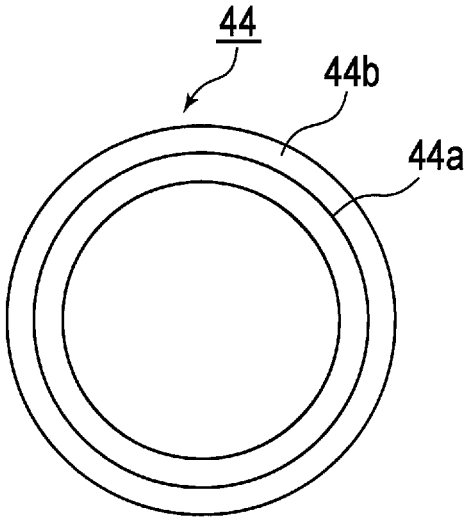
FIG. 5 is a sectional view of a press roller according to the first embodiment of the invention.
Figure 6:
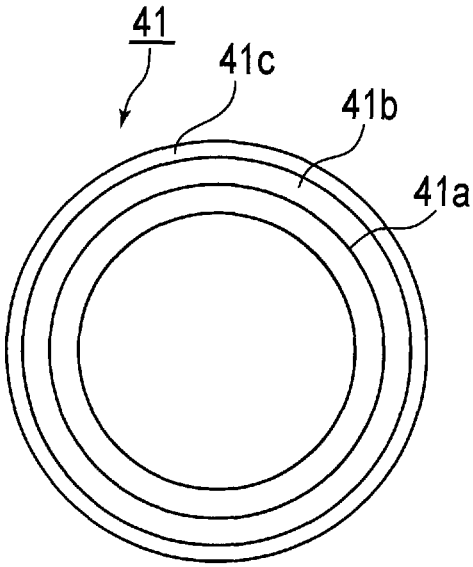
FIG. 6 is a sectional view of a second example of the fixation roller according to the first embodiment of the invention.
Figure 7:
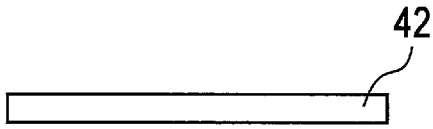
FIG. 7 is a sectional view of a first example of an endless belt according to the first embodiment of the invention.
Figure 8:
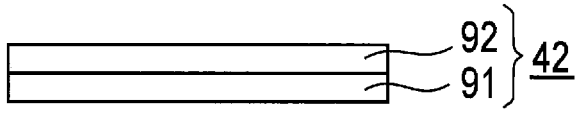
FIG. 8 is a sectional view of a second example of the endless belt according to the first embodiment of the invention.
Figure 9:
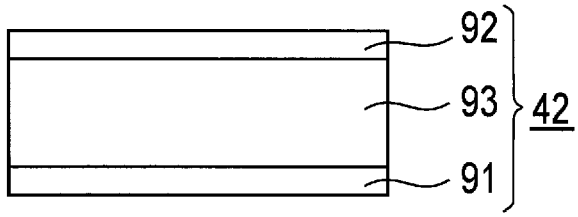
FIG. 9 is a sectional view of a third example of the endless belt according to the first embodiment of the invention.
Figure 10:
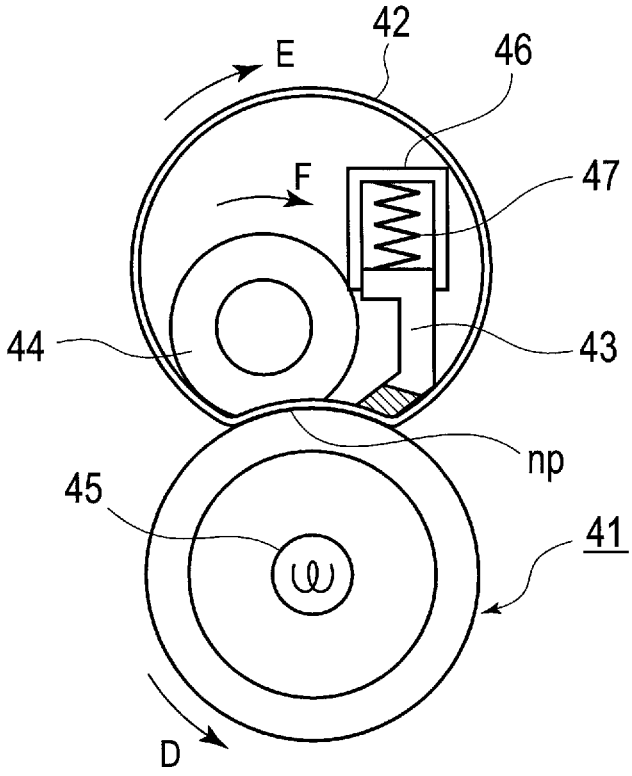
FIG. 10 is a sectional view of a modification of the fixation unit according to the first embodiment of the invention.

FIG. 3 is a sectional view of the fixation unit of the first embodiment according to the invention, FIG. 4 is a sectional view of a first example of the fixation roller of the first embodiment, FIG. 5 is a sectional view of the press roller of the first embodiment, FIG. 6 is a sectional view of a second example of the fixation roller according to the first embodiment, FIG. 7 is a sectional view of a first example of the endless belt of the first embodiment, FIG. 8 is a sectional view of a second example of the endless belt of the first embodiment, FIG. 9 is a sectional view of a third example of the endless belt of the first embodiment, FIG. 10 is a sectional view of a modification of the fixation unit of the first embodiment.

In FIG. 3, reference numeral 41 designates a fixation roller, serving as a rotation member for heating, provided rotatable in arrow direction A; reference numeral 42 designates an endless belt (referred to as a fixation belt), serving as a conveyance member, which is movable (rotatable) in arrow direction B while being in press-contact with fixation roller 41 and conveys the sheet (the medium); reference numeral 43 designates a press pad, serving as a first press member, which is provided in endless belt 42 and supported by holder 46 and whose tip is in contact with the inner surface of endless belt 42 to push the endless belt 42 against fixation roller 41; reference numeral 46 designates the holder, serving as a support member, which supports press pad 43; reference numeral 47 designates a spring, serving as a bias member, which presses press pad 43 against fixation roller 41 via endless belt 42; reference numeral 44 designates a press roller, serving as a pressing rotation member or as a second press member, which is provided rotatable in arrow direction C in endless belt 42 while being in contact with endless belt 42 and pushes endless belt 42 against fixation roller 41; and reference numeral 45 designates a halogen lamp, serving as a heating element, provided in fixation roller 41. Press roller 44 is provided downstream of press pad 43 in the moving direction of endless belt 42 and the conveyance direction of the sheet. Note that each of press pad 43 and press roller 44 is a sandwiching member to sandwich endless belt 42 with fixation roller 41.

In addition to spring 47 provided at the lower end of press pad 43, unillustrated springs, serving as bias members, are provided at axial ends of the rotational shaft of press roller 44. Thus, press pad 43 and press roller 44 are biased toward endless belt 42 by the bias forces of spring 47 and the unillustrated springs, to cause endless belt 42 to be pushed against fixation roller 41. The load pressing fixation roller 41 by press pad 43 via endless belt 42 is set 10 kgf and the total load, which is the load pressing fixation roller 41 by press pad 43 and press roller 44 via endless belt 42, is set 20 kgf.

Fixation roller 41 is provided with an unillustrated gear attached to a longitudinal end of fixation roller 41. The unillustrated gear is interlocked with an unillustrated driving gear for the fixation unit provided in printer body 40, and the driving gear is connected to an unillustrated fixation motor, serving as a fixation unit driver. Upon driving the fixation motor, the rotation of the fixation motor is transmitted through the driving gear and the gear to fixation roller 41, so that the rotation of fixation roller 41 causes endless belt 42 to move (rotate). The movement of endless belt 42 causes press roller 44 to rotate and conveys the sheet. A part of endless belt 42 between press roller 44 and press pad 43 in the circumferential direction of endless belt 42 is in contact with fixation roller 41, thereby forming nip np therebetween.

As shown in FIG. 4, fixation roller 41 includes cylindrical tubular metal core 41*a* and elastic layer 41*b* covering core 41*a*. As shown in FIG. 5, press roller 44 includes cylindrical tubular metal core 44*a* and elastic layer 44*b* covering core 44*a*.

As shown in FIG. 6, fixation roller 41 may have mold release layer 41*c* on elastic layer 41*b*. Likewise, press roller 44 may have a mold release layer on elastic layer 44*b*. Note that, cores 41*a* and 44*a* are tubes made of metal such as aluminum, iron, stainless steel, or the like, to maintain their stiffness property to a constant value. Elastic layers 41*b* and 44*b* are generally made of high heat-resistant rubber material such as a silicone rubber, a spongy silicone rubber, a fluororubber, or the like.

Since endless belt 42 moves while being pressed against fixation roller 41 by press pad 43 and press roller 44 and is heated by fixation roller 41, endless belt 42 needs to have flexibility, rigidity, and heat-resistance.

Thus, as shown in FIG. 7, endless belt 42 is formed in a thin shape and made of metal such as nickel, stainless steel, or heat resistant resin such as polyimide.

In the case where endless belt 42 is made of metal, the thickness of endless belt 42 is equal or more than 30 μm and equal or less than 50 μm. In the case where endless belt 42 is made of polyimide, the thickness of endless belt 42 is equal or more than 50 μm and equal or less than 100 μm.

In the case where printer 10 is capable of executing a double-side printing, the separation performance between endless belt 42 and the sheet is required to be high, since the side of the sheet on which the toner image has been fixed comes in press-contact with endless belt 42 in the double-side printing.

Therefore, in the third example of endless belt 42 as shown in FIG. 8, endless belt 42 includes thin base 91 made of metal such as nickel, stainless-steel or heat resistant resin such as polyimide and mold release layer 92 cladded on the surface of thin base 91, which comes in contact with fixation roller 41. Mold release layer 92 is made of resin having low free energy on its surface and high heat-resistance, which may be fluorine type resin such as PTFE (polytetrafluoroethylene), PFA (perfluoroalcoxyalkane), FEP (perfluoroethylene-propene copolymer), or the like, for example. The thickness of mold release layer 92 is designed within a range from 10 to 50 μm, to avoid the thickness from getting too thin by abrasion and to maintain the thermal conductivity.

In this case, since endless belt 42 and fixation roller 41 are in contact with each other, the heat generated by fixation roller 41 is transferred to base 91 of endless belt 42, press pad 43, and press roller 44. This may deteriorate base 91, press pad 43, press roller 44, and the like, thereby lowering their durability. Therefore, in the third example of endless belt 42 as shown in FIG. 9, elastic layer 93 serving as an intermediate layer is cladded on base 91 and mold release layer 92 is cladded on elastic layer 93. Elastic layer 93 is made of a material that has low hardness and high heat-resistance, such as a silicone rubber, for example. The thickness of elastic layer 93 is designed within a range equal or more than 50 μm and equal or less than 300 μm.

Next, operation of fixation unit 35 will be described.

Upon start of printing by printer body 40, the fixation motor is driven to rotate fixation roller 41. The rotation of fixation roller 41 causes endless belt 42 to move (rotate) with the frictional force occurring between fixation roller 41 and endless belt 42. The movement of endless belt 42 causes press roller 44 to rotate with the friction force occurring between endless belt 42 and press roller 44, as endless belt 42 is in slide-contact with press pad 43.

The controller controls power distribution to halogen lamp 45 provided in fixation roller 41 to cause halogen lamp 45 to generate heat, resulting in heating fixation roller 41. A temperature sensor, serving as a temperature detector, provided at fixation roller 41 detects the temperature of the surface of fixation roller 41 and transmits the output of the temperature sensor to the controller. The controller controls the power distribution to halogen lamp 45 to control the temperature detected by the temperature sensor to a predetermined temperature range, that is, a fixable temperature.

When the sheet on which the color toner image is attached is conveyed to and reaches fixation unit 35, fixation roller 41 heats the color toner image while press pad 43 and press roller 44 press the sheet at a predetermined pressure by pressing endless belt 42 against fixation roller 41. With this, the color toner image on the sheet is fixed on the sheet.

In fixation unit 35 of the embodiment, fixation roller 41 is provided above conveyance path 25 whereas endless belt 42, press pad 43, press roller 44, and the like are provided beneath conveyance path 25.

As shown in FIG. 10, fixation unit 35 may be modified such that fixation roller 41 is provided beneath conveyance path 25 whereas endless belt 42, press pad 43, press roller 44, and the like are provided above conveyance path 25.

In the modification shown in FIG. 10, fixation roller 41 is provided rotatable in arrow direction D, endless belt 42 is provided movable (rotatable) in a direction in arrow direction E while being pressed against fixation roller 41, and press roller 44 is provided rotatable in arrow direction F while being in contact with endless belt 42.

Next, press pad 43 will be described.

Figure 11:
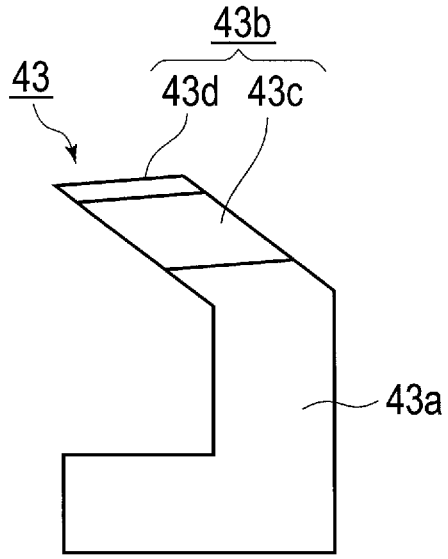
FIG. 11 is a sectional view of the press pad according to the first embodiment of the invention.

FIG. 1 is a sectional view of the surface layer of the press pad according to a first embodiment of the invention. FIG. 11 is a sectional view of the press pad according to the first embodiment of the invention.

Press pad 43 has a predetermined shape, for example, an L-shape in this embodiment. Press pad 43 includes base part 43*a* supported by holder 46 and press part 43*b* obliquely protruded from base part 43*a* in a direction toward press roller 44. Press part 43*b* includes elastic layer 43*c*, serving as an intermediate layer, cladded on the end of base part 43*a*, and surface layer 43*d* cladded on the surface of elastic layer 43*c*.

Base part 43*a* is made of metal such as aluminum, iron, stainless-steel, or the like to maintain its stiffness property.

Elastic layer 43*c* is made of high heat-resistant rubber material such as a silicone rubber, a spongy silicone rubber, a fluoro-rubber, or the like. Elastic layer 43 of this embodiment is made of a thermoset silicone rubber.

Surface layer 43*d* is made of a resin material having a high heat-resistance and a low friction coefficient, such as a silicone type resin, a fluorine type resin, or the like. Surface layer 43*d* is to be in slide-contact with endless belt 42 at a position where press pad 43 and endless belt 42 are in contact with each other, thereby functioning as a slide part of press pad 43.

In the embodiment, surface layer 43*d* is a coating layer formed on elastic layer 43*c* by applying a coating liquid made of a silicone type resin on elastic layer 43*c* and such surface layer 43 includes base material portion 43*e* and spherical silicone beads 43*f* scattered in base material portion 43*e* by dispersion. All or some of silicone beads 43*f* are buried in base material portion 43*e* while being partially protruded (exposed) from base material portion 43*e*, such that the surface of surface layer 43*d* is a rough surface consisting of asperities with spherical convex surfaces.

Note that the coating liquid is formed by adding coccoid fine particles as a solid lubricant, which are silicone beads 43*f* formed of spherical silicone resin fine particles in the embodiment, to a coating base material which is formed by adding an epoxy modified silicone and an aminosilane to a silicone rubber.

The diameter of silicone beads 43*f* is equal or more than 10 μm and equal or less than 20 μm, the sphericity of silicone beads 43*f* is equal or more than 0.6. The thickness of surface layer 43*d* is equal or more than 20 μm and equal or less than 40 μm, and the surface roughness of silicone beads 43*f* is equal or more than 15 μm in ten point mean roughness Rz. The surface roughness can be set by adjusting the amount of silicone beads 43*f* added to the coating base material or by adjusting the condition of applying the coating liquid.

Next, experiments are made using printer 10 equipped with fixation unit 35 of this embodiment and using printer 10 equipped with a comparative fixation unit. The load on the fixation motor in fixation unit 35 is compared to the load on the fixation motor in the comparative fixation unit. Table 1 shows the comparison result. Note that the loads on the fixation motor are expressed by using a shaft torque, which is the torque on the rotational shaft of fixation roller 41.

TABLE 1

| Coating layer | Comparative art | Embodiment |
|---|---|---|
| Thickness (μm) | 15 to 20 | 26 to 28 |
| Ten point mean roughness Rz (μm) | 8.1 | 26.3 |
| Shaft torque (kgf-cm) | 8.3 | 4.6 |

For the experiment, the configuration in either of the comparative fixation unit and fixation unit 35 of the embodiment is designed as follows. To print on sheets of A4 size, press pad 43 is designed such that the length of surface layer 43*d* in the longitudinal direction of surface layer 43*d* (the axial directions of fixation roller 41 and press roller 44) is 230 mm, the length of surface layer 43*d* in the widthwise direction of surface layer 43*d* (the moving direction of endless belt 42) is 7 mm. The load pressing fixation roller 41 by press pad 43 via endless belt 42 is 10 kgf.

Fixation roller 41 is designed such that the outer diameter of fixation roller 41 is 29 mm, elastic layer 41*b* is made of a silicone rubber, the hardness of elastic layer 41*b* is 20° (measured with a Asker-C hardness tester under a constant load of 9.8 N), and the thickness of elastic layer 41*b* is 0.8 mm. Press roller 44 is designed such that the outer diameter of press roller 44 is 18 mm, elastic layer 44*b* is made of silicone rubber, the hardness of elastic layer 44*b* is 53° (measured using JIS-A), and the thickness of elastic layer 44*b* is 1.0 mm. The load pressing endless belt 42 against fixation roller 41 by press roller 44 is 10 kgf, and thus the total load, which is the load pressing endless belt 42 against fixation roller 41 by press pad 43 and press roller 44, is 20 kgf.

For the experiment, in fixation unit 35 of the embodiment, the coating base material for surface layer 43*d* is formed by adding an epoxy modified silicone and an aminosilane to a silicone rubber, and the coating liquid is formed by adding silicone beads 43*f* to the coating base material. The thickness of surface layer 43*d* is equal or more than 26 μm and equal or less than 28 μm, and ten point mean roughness Rz is 26.3 μm.

For the experiment, in the comparative fixation unit, the coating base material of the surface layer of the press pad is formed by an epoxy modified silicone and an aminosilane to silicone rubber, and the coating liquid is formed by adding graphite grains serving as a solid lubricant to the coating base material. The thickness of the surface layer of the press pad is equal to or more than 15 μm and equal to or less than 20 μm, and ten point mean roughness Rz is 8.1 μm.

Each of printer 10 equipped with the comparative fixation unit and printer 10 equipped with fixation unit 35 of the embodiment continuously prints on A4 size sheets at the printing speed of 40 sheets per minute, and then the shaft torques of the comparative fixation unit and fixation unit 35 of the embodiment are measured at the end of a guaranteed duration. Note that the guaranteed duration is to print on 100000 sheets of A4 size with no deterioration of the image quality.

The upper limit of the shaft torque of fixation roller 41 is 8 kgf-cm; if the shaft torque exceeds the upper limit, the fixation motor operation becomes unstable and the fixation motor finally loses steps. In the comparative fixation unit, the shaft torque of fixation roller is 8.3 kgf-cm, which exceeds the upper limit. In contrast, in fixation unit 35 of the embodiment, the shaft torque of fixation roller 41 is 4.6 kgf-cm, which does not exceed the upper limit.

In general, fine particles are manufactured by physically crushing a chief material, and thus have an angular shape. The graphite grains as the solid lubricant in the comparative fixation unit are also manufactured by physically crushing a chief material, and thus have an angular shape.

Therefore, in the comparative fixation unit, when the endless belt and the press pad are in slide-contact with each other, the angular graphite grains scrape off the inner circumferential surface of the endless belt and may produce an abrasion powder. If the abrasion powder is attached to the surface of the press pad, the surface of the press pad becomes smooth and thus the contact area between the endless belt and the press pad increases. This hinders reduction of the friction between the endless belt and the press pad which are in slide-contact with each other and thus hinders reduction of the load on the fixation motor.

In contrast, fixation unit 35 of the embodiment uses spherical silicone beads 43*f* as the solid lubricant such that press pad 43 has the asperity having the spherical convex surfaces at the area where press pad 43 is in contact with endless belt 42. This prevents the inner circumferential surface of endless belt 42 from being scrapped off. Accordingly, the amount of the abrasion powder that is attached to the surface of press pad 43 is reduced and this prevents the surface of press pad 43 from becoming smooth to prevent increase of the contact area between endless belt 42 and press pad 43. Therefore, the friction between endless belt 42 and press pad 43 when they are in slide-contact with each other is maintained low and the load on the fixation motor is maintained low for a long period of time, Consequently, the embodiment stabilizes the operation of the fixation motor and prevents the fixation motor from losing steps.

Further, the embodiment need not use a lubricant agent such as grease to reduce the friction. That is, there is no lubricant agent that would leak from fixation unit 35, mess up and deteriorate the periphery of fixation unit 35, and smear the sheet thereby deteriorating the image quality.

Note that although surface layer 43*d* of press pad 43 is provided with silicone beads 43*f* in the embodiment, it is possible that a surface layer with silicone beads being scattered therein is formed on the inner circumferential surface of endless belt 42. In such a case, since the area of the inner circumferential surface of endless belt 42 is greater than the area of the surface of press pad 43, amounts of the coating liquid and the silicone beads added to the coating liquid to form the surface layer on the inner circumferential surface of endless belt 42 are required larger than those in the embodiment. This increases the cost of fixation unit 35. Also, in such a case, members except for press pad 43 that are in contact with the inner circumferential surface of endless belt 42, such as press roller 44, cannot rotate stably. In other words, in the case where the surface layer with the silicone beans scattered therein is formed on the inner circumferential surface of endless belt 42, press roller 44 slides more easily with respect to endless belt 42 and press roller 44 thus cannot rotate stably, since press roller 44 is to be rotated by the friction between endless belt 42 and press roller 44. With this, the load pressing fixation roller 41 by press roller 44 via endless belt 42 may vary. This hinders pressing the color toner image on the sheet between fixation roller 41 and endless belt 42 at a constant pressure, resulting in poor fixation of the color toner image.

In light of this, in the embodiment, silicone beads 43*f* are provided in surface layer 43*d* forming the surface of press pad 43, without providing the silicone beads to the inner circumferential surface of endless belt 42.

Note that the sheet passing through fixation unit 35 is heated by fixation roller 41 and pressed by press pad 43 and press roller 44. In general, during such a fixation process, the sheet may be wrinkled (that is, a fixation wrinkle may occur) and the color toner image may be fixed out of position (that is, an image displacement may occur), which results in deterioration of the image quality. It is known that such occurrences of the fixation wrinkle and the image displacement are related to the pressure distribution of nip np (FIG. 3) along a longitudinal direction of nip np (axial directions of fixation roller 41 and press roller 44).

Therefore, to prevent the occurrences of fixation wrinkle, image displacement, and the like, it may be proposed that the diameter of either of fixation roller 41, press roller 44, or the like should be varied along the longitudinal direction such that the diameter at a position closer to the longitudinal center of nip np is larger and the diameters at a position closer to each the longitudinal end of nip np is smaller, so that the pressure at the position closer to the longitudinal center of nip np is higher and the pressure at the position closer to each of the longitudinal ends of nip np is lower.

Also, to prevent the occurrences of fixation wrinkle, and image displacement, and the like, it may be proposed that an area of the surface of press pad 43 closer to the center of press pad 43 in the longitudinal direction of fixation roller 42 be configured closer to fixation roller 42 so as to make the pressure of nip np larger whereas the area of the surface of press pad 43 closer to the end of press pad 43 in longitudinal direction of fixation roller 42 be configured farther away from fixation roller 42 so as to make the pressure of nip np lower.

However, in the case where the pressure occurring at nip np is set based on the shape of press pad 43, the inner circumferential surface of endless belt 42 at a high pressure position is easily scraped off but the inner circumferential surface of endless belt 42 at a low pressure position is rarely scraped off, when endless belt 42 is in slide contact with press pad 43.

In such a case, if silicone beads 43*f* are uniformly scattered in the entire surface layer 43*d* like the first embodiment, the amount of silicone beads 43*f* in the coating liquid would become greater, resulting in rising the cost of fixation unit 35.

In light of this, a second embodiment of the invention, which will be described below, varies the density of silicone beads 43*f* in surface layer 43*d* depending on the position in press pad 43 along the longitudinal direction. Note that in the second embodiment, the same configuration as that of the first embodiment is designated by the same reference numerals and, the description of the same effect as that of the first embodiment due to the same configuration will be omitted.

Figure 12:
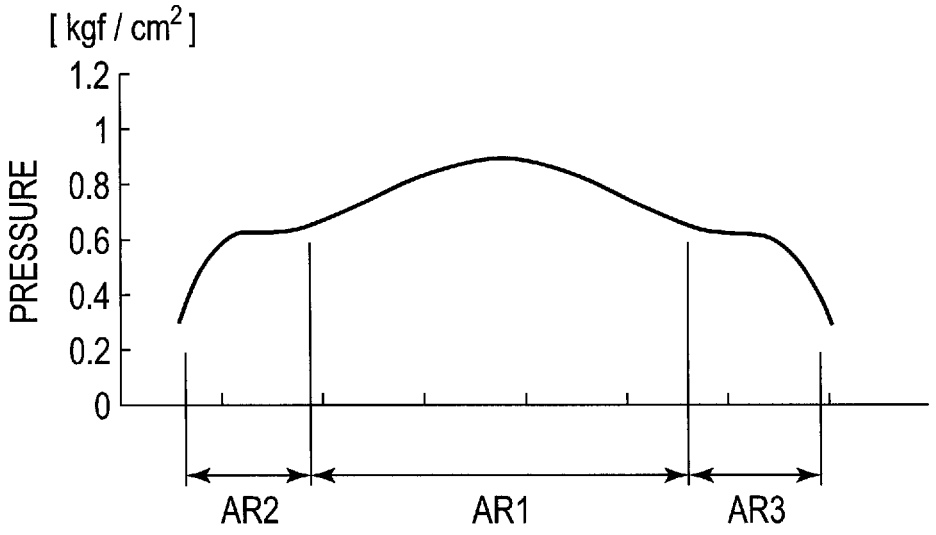
FIG. 12 is a sectional view of the pressure distribution of the press pad according to a second embodiment of the invention.

FIG. 12 is a sectional view of a pressure distribution at a press pad according to the second embodiment of the invention.

The second embodiment employs a structure wherein, as shown in FIG. 12, the pressure at first region AR1 of press pad 43 (serving as a first press member), which is a center portion of press pad 43 in the longitudinal direction, is high while the pressures at second regions AR2 and AR3 of press pad 43, which are end portions of press pad 43 in the longitudinal direction, are low. Therefore, a part of the inner circumferential surface of endless belt 42 corresponding to first region AR1 is easily scraped off producing the abrasion powder whereas parts of the inner circumferential surface of endless belt 42 corresponding to second regions AR2 and AR3 are rarely scraped off.

To reduce the amount of the abrasion powder produced from first region AR1 of the inner circumferential surface of endless belt 42, the second embodiment is configured such that the density of silicone beads 43*f* of surface layer 43*d* at first regions AR1 is large while the density of silicone beads 43*f* of surface layer 43*d* at each of second regions AR2 and AR3 is small or zero. That is, the slide part having plural spherical convex surfaces is provided at first region AR1 and is not provided at either of second regions AR2, AR3. Note that second region AR2 or AR3 of the surface layer of press pad 43 may include the graphite grains, like the comparative fixation unit.

With this, the amount of silicone beads 43*f* added to the coating liquid can be reduced, so as to reduce the cost of fixation unit 35 serving as the fixation device.

Note that, although the second embodiment employs the structure wherein, as shown in FIG. 12, the pressure at region AR1, which is the center portion of press pad 43 in the longitudinal direction is high while the pressures at regions AR2 and AR3, which are the end portions of press pad 43 in the longitudinal direction are low, a modification of the second embodiment may employ a structure wherein the pressure at region AR1, which is the center portion of press pad 43 in the longitudinal direction, is low while the pressures at regions AR2 and AR3, which are the end portions of press pad 43 in the longitudinal direction, are high. In such a structure, the density of silicone beads 43*f* at region AR1 of surface layer 43*d* is designed small or zero while the density of silicone beads 43*f* at each of regions AR2 and AR3 of surface layer 43*d* is set large.

Note that, like the first embodiment, it may be proposed that the surface layer with the silicone beads be formed to the inner circumferential surface of endless belt 42 serving as a conveyance member and a fixation belt, however, such a proposed structure would increase the amount of coating liquid and the silicone beads added to the coating liquid required to form the surface layer of the inner circumferential surface of endless belt 42, resulting in increasing the cost of fixation unit 35. Accordingly, in the second embodiment, silicone beads 43*f* are provided to surface layer 43*d* of press pad 43 and are not provided to the inner circumferential surface of endless belt 42.

Here, as shown in FIG. 10, fixation roller 41 is provided beneath conveyance path 25; endless belt 42, press pad 43, press roller 44, and the like are provided above conveyance path 25; and halogen lamp 45 is provided in fixation roller 41. In such a structure, fixation roller 41 indirectly heats the toner image on an upper side of the sheet by heating the toner image through the sheet from a lower side of the sheet, and thus the toner image might be inadequately fused.

In light of this, a third embodiment of the invention, which will be described below, provides a sheet heating element serving as a heating element in endless belt 42.

Figure 13:
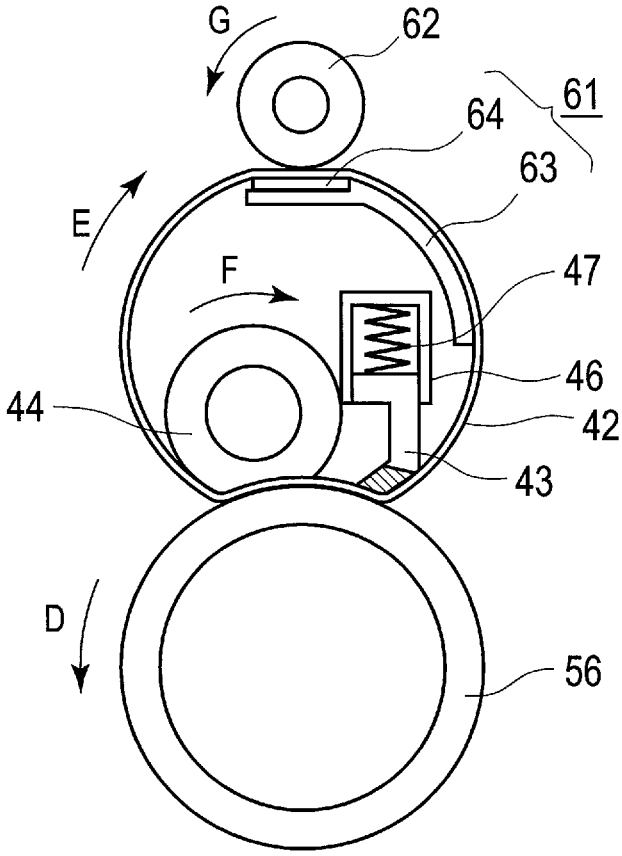
FIG. 13 is a sectional view of a fixation unit according to a third embodiment of the invention.
Figure 14:
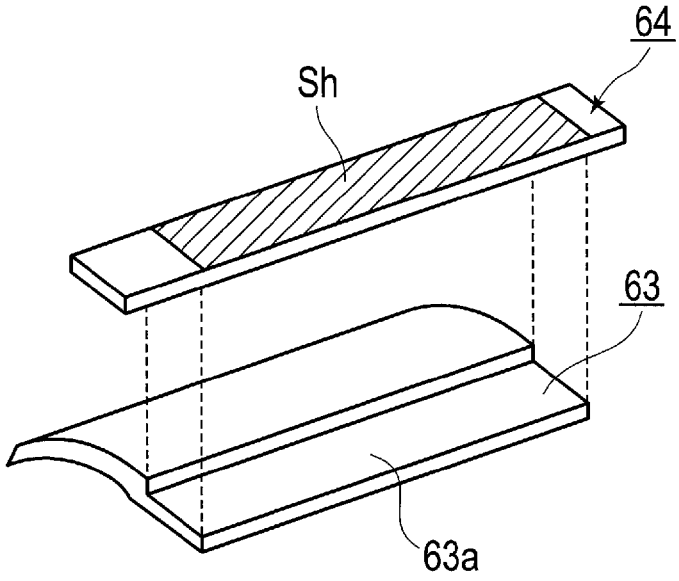
FIG. 14 is an exploded perspective view of a heat device according to the third embodiment of the invention.
Figure 15:
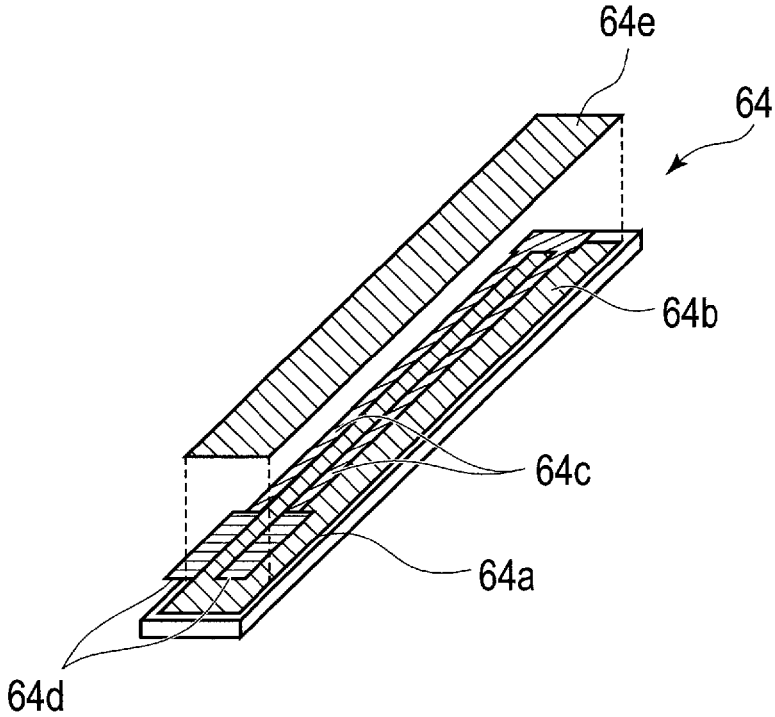
FIG. 15 is an exploded perspective view of a sheet heating element according to the third embodiment of the invention.
Figure 16:
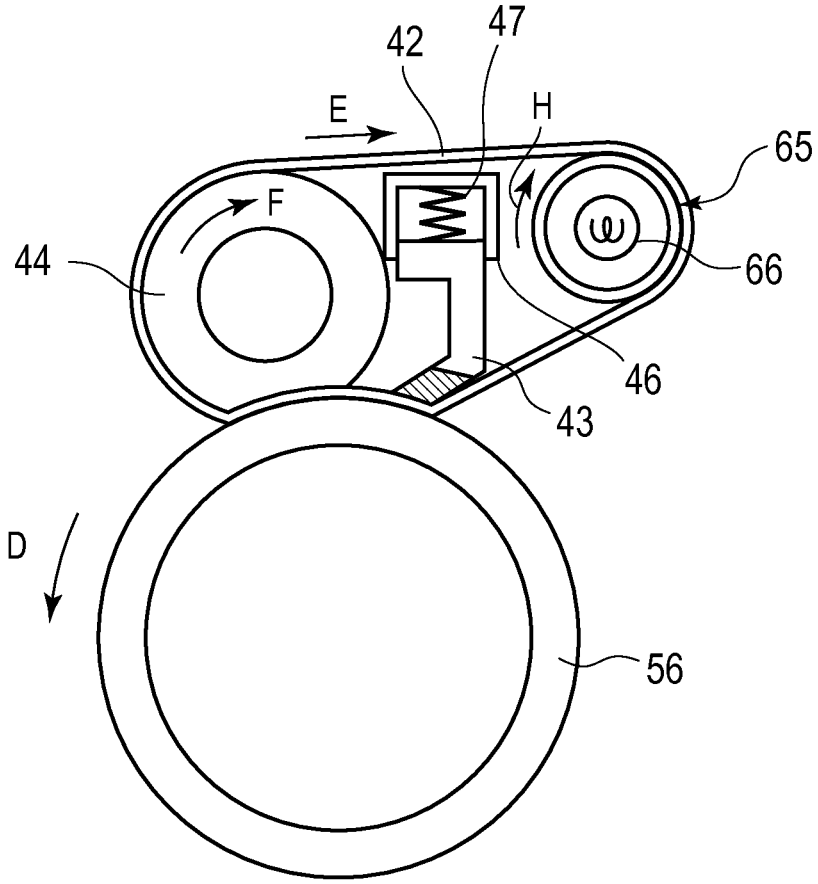
FIG. 16 is a sectional view of a modification of the fixation unit according to the third embodiment of the invention.
Figure 17:
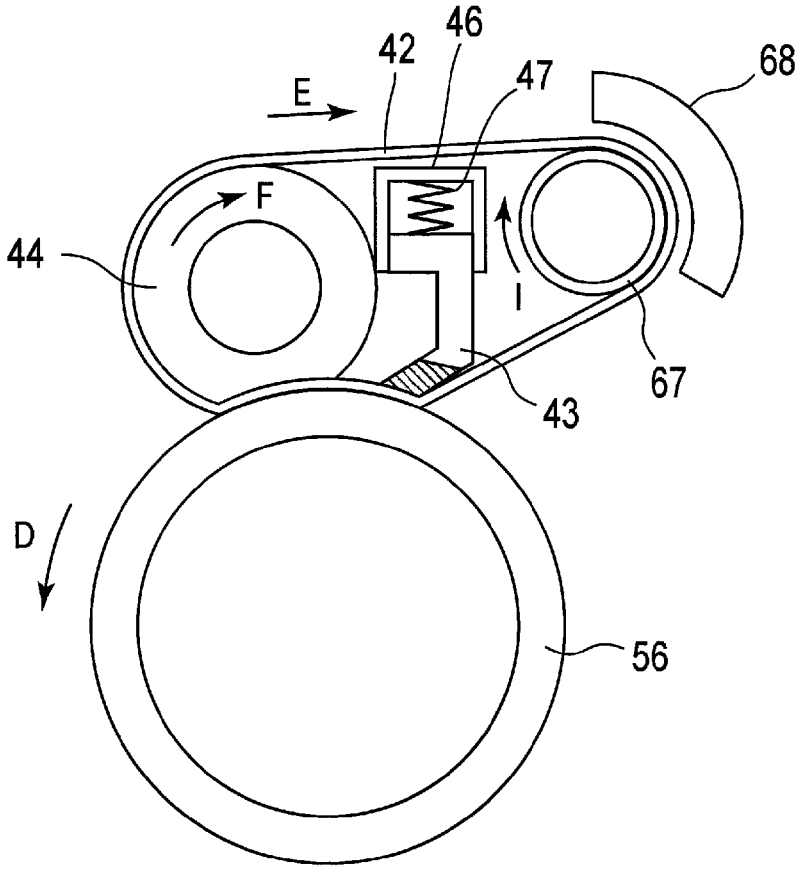
FIG. 17 is a sectional view of another modification of the fixation unit according to the third embodiment of the invention.

FIG. 13 is a sectional view of a fixation unit according to the third embodiment of the invention. FIG. 14 is an exploded perspective view of a heat device according to the third embodiment of the invention. FIG. 15 is an exploded perspective view of a sheet heating element according to the third embodiment of the invention. FIG. 16 is a sectional view of a modification of the fixation unit according to the third embodiment of the invention. FIG. 17 is a sectional view of another modification of the fixation unit according to the third embodiment of the invention.

In the figure, reference numeral 56 designates a fixation roller, as an idler rotation member, provided rotatable in arrow direction D; reference numeral 42 is an endless belt (which may be also referred to as a fixation belt), serving as a conveyance member, provided movable (rotatable) in arrow direction E while being pressed against fixation roller 56; reference numeral 43 designates a press pad, serving as a first press member, attached to holder 46 (a support member) in endless belt 42, having it tip in contact with endless belt 42, and configured to press endless belt 42 against fixation roller 56; reference numeral 44 designates a press roller, serving as a second press member or a rotation member for applying a pressure, provided in endless belt 42 and configured to be rotatable in arrow direction F while being in contact with endless belt 42; reference numeral 61 designates a heat device (stationary member) fixed at a predetermined position in endless belt 42; and reference numeral 62 designates an auxiliary roller, serving as a backup rotation member or an opposed member, provided opposed to heat device 61 with endless belt 42 between auxiliary roller 62 and heat device 61 and configured to be rotatable in arrow direction G. Auxiliary roller 62 is driven to rotate by the movement (the rotation) of endless belt 42.

Heat device 61 includes a support body provided extending along the inner circumferential surface of endless belt 42, and sheet heating element 64 attached to support body 63 while being in contact with endless belt 42 and configured to heat endless belt 42. Auxiliary roller 62 presses endless belt 42 against sheet heating element 64 such that endless belt 42 is in slide contact with sheet heating element 64.

Support body 63 is made of metal, such as aluminum, copper, or the like, that has a high heat conductivity and a high workability, or made of alloy including such a metal as a main component, or made of metal, such as iron, that has a high heat resistance and a high rigidity, or made of alloy, such as stainless steel, including such a metal as a main component.

Spring 47 serving as a support member is provided at each end of support body 63 so as to stretch endless belt 42.

Support body 63 is formed with recess 63*a* to hold sheet heating element 64. Support body 63 and sheet heating element 64 are bonded to each other but are integrated to each other with auxiliary roller 62 pressing sheet heating element 64 via endless belt 42.

Sheet heating element 64 is a ceramic heater, a stainless heater, or the like, and surface Sh thereof, which is to be in contact with the inner circumferential surface of endless belt 42, is a flat surface or a circular arc surface.

Sheet heating element 64 includes base plate 64*a* made of SUS430 or the like, electrically insulating layer 64*b* is a thin glass film formed on base plate 64*a*, resistance heating element 64*c* formed of a paste on electrically insulating layer 64*b*, electrode 64*e* at each end of resistance heating element 64*c*, and protective layer 64*e* covering electrode 64*e* and the like. Note that protective layer 64*e* comprises contact surface Sh in this embodiment, base plate 64*a*, however, may form contact surface Sh by turning sheet heating element 64 over.

Resistance heating element 64*c* is formed by screen-printing powder of either a nickel-chromium alloy or a silver-palladium alloy, or the like. Electrode 64*e* is made of either a chemically stable metal having lower electrical resistance such as silver or a high-melting-point metal such as tungsten. Protective layer 64*d* is made of glass or a fluorine-containing resin such as PTFE, PFA, FEP or the like.

Like fixation roller 41, press roller 44, or the like of the first embodiment, each of fixation roller 56 and auxiliary roller 62 includes a core, an elastic layer, and a mold release layer; the core is formed of a tube made of metal such as aluminum, iron, stainless-steel; the elastic layer is made of a rubber material such as a silicone rubber, a spongy silicone rubber, a fluoro-rubber, or the like; and the mold release layer is made of a fluorine-containing resin such as PTFE, PFA, FEP or the like.

Note that the elastic layer and the mold release layer may be replaced with a sponge, a felt, or the like with a mold release agent such as silicone oil, fluorine-type oil, or the like applied thereto.

In the third embodiment, sheet heating element 64 heats endless belt 42, and thus endless belt 42 directly heats the toner image (the developer image) on the sheet (the medium)

from the front side of the sheet. With this, the second embodiment is able to fuse the toner image adequately, resulting in improving the image quality.

Note that, as shown in FIG. 16, heat device 61 of the third embodiment may be replaced with heated roller 65, serving as heating auxiliary rotation member, with halogen lamp 66 serving as a heating element provided in heat roller 65. Such heated roller 65 is formed of a tube made of metal such as aluminum, iron, stainless-steel, or the like and provided rotatable in arrow direction H, so as to be rotated by the movement (the rotation) of endless belt 42.

In the configuration shown in FIG. 16, the controller controls the power distribution to halogen lamp 66 provided in heat roller 65 to heat halogen lamp 66, heat roller 65, and endless belt 42.

Also, as shown in FIG. 17, heat device 61 of the third embodiment may be replaced with auxiliary roller 67, serving as a backup auxiliary rotation member, provided in endless belt 42, and electromagnetic type heater 68, serving as a heating element, opposed to auxiliary roller 67 via endless belt 42. Auxiliary roller 67 is formed of a tube made of metal such as aluminum, iron, stainless-steel, or the like and provided rotatable in arrow direction I, so as to be rotated by the movement (the rotation) of endless belt 42.

In the configuration shown in FIG. 17, the controller controls the power distribution to an unillustrated coil provided in electromagnetic type heater 68 to heat electromagnetic type heater 68 and endless belt 42.

The foregoing describes fixation unit 35 provided in printer 10; the invention may be applied to a fixation unit in a copy machine, a facsimile machine, a multifunctional printer/peripheral, or the like.

The foregoing describes press pad 43 in fixation unit 35; the invention may be applied to a member that is required to have an abrasion resistance.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A fixation device comprising:
a rotation member provided to be rotatable;
a conveyance member provided in contact with the rotation member and configured to convey sheet media upon which developer images are fixed; and
a first press member configured to press the conveyance member against the rotation member, wherein the first press member includes:
a base;
an elastic layer provided on the conveyance member's side of the base; and
a surface layer coating the elastic layer and configured to be in slide-contact with the conveyance member, wherein the surface layer includes:
a base material portion; and
spherical particles provided on the conveyance member's side of the base material portion, wherein each of the spherical particles includes a first portion which is buried in the base material and a second portion which protrudes from the base material and is at least in partial contact with the conveyance member.

2. The fixation device according to claim 1, wherein the rotation member includes a heating element.

3. The fixation device according to claim 1, further comprising
a second press member provided downstream of the first press member in the movement direction of the conveyance member and configured to press the conveyance member against the rotation member.

4. The fixation device according to claim 3, wherein
the conveyance member is moved according to the rotation of the rotation member,
the second press member is rotated according to the rotation the rotation member.

5. The fixation device according to claim 1, wherein the spherical particles comprise silicone beads.

6. The fixation device according to claim 5, wherein
the surface layer has the thickness of not less than 20 μm and not more than 40 μm, and the silicone beads have the diameter of not less than 10 μm and not more than 20 μm.

7. The fixation device according to claim 1, wherein
the base material portion includes silicone resin.

8. The fixation device according to claim 1, wherein the base is made of metal material.

9. The fixation device according to claim 1, wherein the elastic layer is made of silicone rubber.

10. The fixation device according to claim 1, further comprising
a bias member configured to bias the first press member toward the conveyance member.

11. The fixation device according to claim 1, wherein
the conveyance member is an endless belt, and
the slide part is in contact with an inner circumferential surface of the endless belt.

12. The fixation device according to claim 1, wherein
the first press member includes:
a first region provided at a region corresponding to a center portion of the rotation member in the axial direction and configured to press the conveyance member against rotation member at a first pressing force; and
a second region provided at a region corresponding to each end of the rotation member in the axial direction and configured to press the conveyance member against the rotation member at a second pressing force less than the first pressing force, wherein
the amount of the particles in the first region is greater than the amount of the particles in the second region.

13. The fixation device according to claim 12, wherein
the particles are provided in the first region while not being provided in the second region.

14. An image formation apparatus comprising:
a conveyance path along which a sheet media upon which developer images are fixed is conveyed;
an image carrier;
an exposure device configured to emit light onto a surface of the image carrier to form an electrostatic latent image;
a development device configured to supply a developer to the electrostatic latent image to form a developer image;
a transfer unit configured to transfer the developer image to the medium; and
the fixation device according to claim 1 configured to fix the transferred developer image to the medium.

15. A fixation device comprising:
a rotation member provided to be rotatable;
a conveyance member provided in contact with the rotation member and configured to convey sheet media upon which developer images are fixed; and a first press member configured to press the conveyance member against the rotation member, the first press member including a surface layer configured to be in slide-contact with the conveyance member, the surface layer including:

a base material portion; and particles provided on the conveyance member's side of the base material portion, wherein each of the spherical particles includes a first portion which is buried in the base material and a second portion which protrudes from the base material and is at least in partial contact with the conveyance member.

16. A fixation device comprising:

a rotation member provided to be rotatable;

a conveyance member provided in contact with the rotation member and configured to convey media; and a first press member configured to press the conveyance member against the rotation member, wherein the first press member includes:

a base;

an elastic layer provided on the conveyance member's side of the base;

a surface layer coating the elastic layer and configured to be in slide-contact with the conveyance member, wherein the surface layer includes a base material portion and spherical particles provided on the conveyance member's side of the base material portion, wherein a part of each spherical particle is buried in the base material portion;

a first region provided at a region corresponding to a center portion of the rotation member in the axial direction and configured to press the conveyance member against rotation member at a first pressing force; and a second region provided at a region corresponding to each end of the rotation member in the axial direction and configured to press the conveyance member against the rotation member at a second pressing force less than the first pressing force, wherein the amount of the particles in the first region is greater than the amount of the particles in the second region.

17. The fixation device according to claim 16, wherein the particles are provided in the first region while not being provided in the second region.

* * * * *